United States Patent [19]

Ukita et al.

[11] Patent Number: 4,957,596

[45] Date of Patent: Sep. 18, 1990

[54] PROCESS FOR PRODUCING COKE

[75] Inventors: Keizoo Ukita, Yokohama; Tetsuo Hamaguchi, Chigasaki; Masaaki Inoue, Yokohama, all of Japan

[73] Assignee: Nippon Zeon Co., Ltd., Tokyo, Japan

[21] Appl. No.: 366,548

[22] Filed: Jun. 15, 1989

[30] Foreign Application Priority Data

Jun. 17, 1988 [JP] Japan ..... 63-149471

[51] Int. Cl.[5] ..... C10B 57/06

[52] U.S. Cl. ..... 201/20; 201/23

[58] Field of Search ..... 201/9, 20, 21, 23; 34/5

[56] References Cited

U.S. PATENT DOCUMENTS 4,055,471 10/1977 Beck et al. ..... 201/20
4,274,836 6/1981 Ban et al. ..... 201/9
4,624,868 11/1986 Muller ..... 34/5

FOREIGN PATENT DOCUMENTS 46-23495 7/1971 Japan ..... 201/9
55-27332 2/1980 Japan ..... 201/20

OTHER PUBLICATIONS

Russel, "Variations in the Weight Per Cubic Foot of Coal", *Coal and Coke Research*, Koppers Company, Inc., pp. 62–64.

*Primary Examiner*—Joye L. Woodard
*Attorney, Agent, or Firm*—Sherman and Shalloway

[57] ABSTRACT

In a process for producing a coke by carbonization of a starting coal, the improvement wherein a coal containing a bulk density improving agent composed of a high-molecular organic compound capable of forming a hydrous gel in the presence of moisture is used as the starting coal.

11 Claims, No Drawings

PROCESS FOR PRODUCING COKE

BACKGROUND OF THE INVENTION

1. Field of the Invention

This invention relates to a process for producing a coke. More specifically, this invention relates to a process for producing a coke wherein filling density of a starting coal is increased, thereby making it possible to stabilize and improve qualities of the coke.

2. Description of the Prior Art

Cokes used in metallurgy are ordinarily produced by a method which comprises pulverizing one starting coal or a blend of two or more starting coals, charging the pulverizate into a coke oven and conducting carbonization. On this occasion, when filling density of the starting coal(s) within the coke oven is higher, the amount of heat in carbonization can be rendered smaller, and qualities of the resulting cokes are improved. That is, when the same starting coals are used and filled in high density, the cokes of higher qualities can be obtained, and less costly starting coals are usable to afford the cokes of equal qualities.

As a means of filling the starting coal in high density, there is commonly employed a method using a mixture of 10 to 30% by weight of a briquette having previously increased density and 90 to 70% by weight of a slack. This method however requires an equipment for producing the briquette and is therefore economically disadvantageous. Besides, as the uneven distribution of the briquette takes place in charging the starting coal into the coke oven, nonuniformity of qualities of the resulting coke occurs. Adhesion between coal particles provided by the moisture in the slack is indicated as one reason for the uneven distribution of the briquette.

The moisture in the slack is attributed to immersion of rainwater occurring when the starting coals are stacked outdoors or water sprinkling to prevent scattering of a coal dust, and the moisture content is usually 7 to 15% based on the weight of the starting coal.

As a method for preventing segregation of the briquette, there is proposed a method in which various surface active agents are added to the slack mixed with the briquette (Japanese Laid-open Patent Application Nos. 49693/1982 and 57861/1986).

However, it cannot necessarily be said that these methods can provide enough effects. A method is also known wherein the moisture content in the starting coal is reduced by heating the starting coal. This method gives a fixed effect in the aspect of improvement in filling density. Nevertheless, said method not only needs a device and steps for said effect but also seems likely to allow explosion of the dust of the starting coal within the device. For this reason, it cannot be employed.

As another method for increasing filling density of the starting coal, there are proposed methods in which various surface active agents (Japanese Laid-open Patent Application Nos. 21434/1980, 100892/1981 and 68691/1988), or mixtures of oils and surface active agents (Japanese Laid-open Patent Application Nos. 114801/1978 and 283685/1986) are added to the starting slack. However, in these methods, the oils have to be added in large amounts, and the effect becomes maximal with fixed amounts of the surface active agents. Thus, the effect is not altogether enough.

It is an object of this invention to provide a process for producing a high-quality coke which enables filling of a starting coal in high density.

The present inventors have made extensive studies to achieve the object and consequently found that if a starting coal is mixed with a high-molecular organic compound forming a hydrous gel, filling density of the starting coal is improved. This finding has led to completion of this invention.

By the way, it is disclosed in a great many prior arts as will be described below that varying compounds are added to a starting coal in preparing a briquette for production of a coke.

Japanese Laid-open Patent Application No. 18702/1976 discloses a process for producing a pelletized coke for preparation of iron which comprises adding to a slack a water-soluble organic binder selected from compounds having a hydrophilic group such as a hydroxyl group, a sulfonic acid group, an amino group or a carboxyl group and a hydrophobic group such as an aromatic group or a higher aliphatic group (examples thereof are lignin sulfonate, cellulose xanthate, tar sulfonate, alcohol fermentation residues of starches, etc.) as an aqueous solution having a concentration of 10 to 20%, pulverizing the mixture, drying the pulverizate and firing the dried product. Since the resulting pellets are however low in strength owing to the moisture, they cannot be charged as such in a carbonization oven for producing the pelletized coke and a drying step is required.

Japanese Laid-open Patent Application No. 82901/1977 describes that a methyl cellulose is added to a coarse powdery inferior coal. However, this prior art indicates a process in which a coal for producing a coke is prepared by blending a mixture of the inferior coal and a petroleum-type or coal-type bituminous material with a large amount (20 to 80% based on the mixture) of the methyl cellulose to form the inferior coal into an agglomerated powder, and blending it with another coal for coke.

Japanese Laid-open Patent Application No. 27332/1980 discloses binders for preparing briquettes to produce cokes for blast furnace, said binders containing molasses, blackstrap molasses or mixtures of them and surface active agents. This prior art indicates binders for preparing briquettes to produce cokes, the amounts of the binders being preferably 1 to 10% by weight based on the coals.

Japanese Laid-open Patent Application No. 142982/1983 describes a process for producing briquettes charged into a coke oven. The process of this prior art forms a coating on the surface of the briquette at normal temperatures, which coating disappears by thermal decomposition, combustion or evaporation when heated in a coke oven chamber. As a material for forming the coating, high-molecular materials such as polyvinyl acetate, polyvinyl alcohol, polyolefins, polyesters and polyvinyl chloride are available.

Japanese Laid-open Patent Application No. 44583/1985 discloses a process in which a starting coal is blended with a bituminous material and a water-soluble thermosetting material (e.g. starches, pulp waste liquors, molasses and polyvinyl alcohol), and the blend is kneaded and pressure-molded to obtain briquettes for production of cokes.

Japanese Laid-open Patent Application No. 212493/1987 involves a method for determining an amount of a binder for pseudo-powdering a slack to prevent formation of a dust in case of pseudo-powdering the slack to produce a dry coal or a preheated coal. An aqueous solution of dextrin or polyvinyl alcohol is shown as the binder.

The foregoing prior arts are concerned with briquettes used to produce cokes or preparation of the briquettes. They do not aim at improvement in the filling density of the starting coal when obtaining the coke directly from the coal and improvement in qualities of the coke thereby brought forth, nor do they indicate the additives used in this invention.

Additives are added to the coal for the other various purposes than as mentioned above. For instance, U.S. Pat. No. 4,055,471, GB No. 1,496,303, GB No. 1,496,302, NL No. 7,515,201 and DE No. 2,500,606 describe that in order to decrease entraining of a dust in charging a hot coal into a coke oven, aqueous solutions of adhesives such as a sulfide salt waste liquor, a starch, dextrin, molasses, casein and a glue are added, if required, with a coarse coal tar and a wetting agent. According to this method, coal fine particles are agglomerated by the action of the above adhesive aqueous solutions, etc., to prevent entraining of the coal dust. The adhesive is added as an aqueous solution having a concentration of 30 to 70%. Said method differs from this invention in additives and purpose thereof.

It is not said that mixing the coal with a hydrous gel used in this invention or its similar compounds has not been so far conducted at all.

For example, Japanese Laid-open Patent Application No. 60784/1986 contemplates a method for reducing the moisture content of products piled outdoors characterized in that when loading or delivering raw materials (coals, etc.) stacked outdoors, a water-absorbing molded article made of a water-absorbing resin is localized in and/or on the raw materials to absorb to said water-absorbing molded article the moisture or rainwater adhered to the raw materials, and the water-absorbing molded article is then separated from the raw materials.

Japanese Laid-open Patent Application No. 111209/1986 discloses that in order to prevent immersion of rainwater into carbonaceous materials stacked outdoors, a water-absorbing polymer is scattered on the carbonaceous materials to form coatings on their surfaces.

Japanese Laid-open Patent Application No. 151294/1986 discloses that in order to save energy by reducing a moisture in a coal, said coal is mixed with a water-absorbable and -desorbable resin to adsorb the moisture in the coal to the resin, then separating the coal from the resin, removing water from the recovered resin, and reusing said resin to remove the moisture in the coal.

The methods disclosed in the above literature are however different from this invention in the purpose and period of adding the additives to the coal, the position of storing (using) the coal to which the additives are added, or the use method of the additives.

Summary of the Invention

This invention provides a process for producing a coke by carbonization of a starting coal characterized in that a coal containing a bulk density improving agent composed of a high-molecular organic compound capable of forming a hydrous gel in the presence of moisture is used as a starting coal.

This invention further provides, as a preferable embodiment, a process for producing a coke by carbonization of a starting coal characterized in that a coal containing a bulk density improving agent composed of a high-molecular organic compound capable of forming a hydrous gel and a surface active agent is used as a starting coal.

This invention still further provides, as another preferable embodiment, a process for producing a coke by carbonization of a starting coal characterized in that a coal containing a bulk density improving agent composed of a high-molecular organic compound capable of forming a hydrous gel, a surface active agent and a mineral oil is used as a starting coal.

According to the above preferable embodiment wherein the surface active agent or the surface active agent and the mineral oil are conjointly used with the high-molecular organic compound capable of forming the hydrous gel, the better effect in bulk density improvement can be provided.

Description of Preferred Embodiments

As the starting coal in this invention, a slack is ordinarily used, but a mixture of a slack and a briquette is also available.

The high-molecular organic compound capable of forming the hydrous gel in the presence of moisture which is used in this invention is not particularly limited if it absorbs or adsorbs water to form a hydrous gel. One example thereof is a natural water-soluble high-molecular compound or a chemically modified natural water-soluble high-molecular compound having a polar group such as a hydroxyl group, an amino group or a carboxyl group. Said water-soluble high-molecular compound, when dissolved in water, bonds water to the polar group in the molecule to form the hydrous gel.

Concrete examples of such water-soluble high-molecular compounds are proteins such as gelatin, collagen and casein; polysaccharides such as pectin, agar, starch, derivatives thereof, alginic acid salts, carrageenan, chitosan and gum arabic; and celluloses such as methyl cellulose, ethyl cellulose, carboxymethyl cellulose and hydroxyethyl cellulose.

Another example of the high-molecular organic compound capable of forming the hydrous gel in the presence of moisture which is used in this invention is a water-insoluble synthetic resin having a high-molecular network three-dimensionally crosslinked physically or chemically and capable of absorbing or adsorbing a distilled water in an amount which is 5 to 1000 times its own weight. The resin absorbs or adsorbs water within the high-molecular network to form a hydrous gel. The water-insoluble synthetic resin can be a resin that is formed by a known method. Examples of such resin are compounds obtained by introducing physical or chemical crosslinkage into water-soluble high-molecular synthetic compounds (e.g. a starch-acrylonitrile copolymer hydrolyzate, a polyacrylonitrile hydrolyzate, polyethylene oxide, a vinyl acetate-acrylic acid salt copolymer hydrolyzate, a vinyl acetate-acrylic acid ester copolymer hydrolyzate, a vinyl alcohol-acrylic acid salt copolymer, a polyacrylic acid salt and an olefin-maleic anhydride copolymer hydrolyzate); and compounds obtained by crosslinking water-insoluble high-molecular compounds and then imparting a hydrophilic moiety via hydrolysis. Examples of a method for introducing the crosslinkage are a method in which a polar group is introduced into a high-molecular compound to allow intermolecular or intramolecular hydrogen bonding, a method using a polyfunctional crosslinking agent in forming a high-molecular compound, a method in which crosslinking is conducted by the reaction between functional groups contained in a high-molecular compound or irradiation, and a method in which a hydrophobic group or a crystalline structure is introduced into a high-molecular compound.

Two or more of the high-molecular organic compounds forming the hydrous gel can be used in this invention.

The surface active agent used in this invention is not particularly limited and may be any of an anionic surface active agent, a nonionic surface active agent, a cationic surface active agent or an ampholytic surface active agent. Above all, the anionic and nonionic surface active agents are preferable.

Concrete examples of the anionic surface active agent available in this invention are carboxylic acid salts such as higher aliphatic acid alkali salts (soaps), N-acylamino-acid salts, alkyl ether carboxylic acid salts and acylated peptides; sulfonic acid salts such as alkyl sulfonic acid salts, alkylarylsulfonic acid salts, sulfosuccinic acid salts, alpha-olefin sulfonic acid salts and N-acylsulfonic acid salts; sulfuric acid ester salts such as sulfated oils, alkyl sulfuric acid salts, alkyl ether sulfuric acid salts, alkylaryl ether sulfuric acid salts and alkylamide sulfuric acid salts; and phosphoric acid ester salts such as alkylphosphoric acid salts, alkyl ether phosphoric acid salts and alkylaryl ether phosphoric acid salts. A surface active agent having a nonionic surface active moiety such as a polyoxyethylenealkyl(aryl) ether sulfuric acid salt is also included in the anionic surface active agent. Types of the salts can be sodium salts, potassium salts and ammonium salts, but these are not critical.

Concrete examples of the nonionic surface active agent available in this invention are ether-type nonionic surface active agents such as alkylpolyoxyethylene ethers, alkylarylpolyoxyethylene ethers, alkylarylformaldehyde-condensed polyoxyethylene ethers, block polymers containing polyoxypropylene as a lipophilic group; ether ester-type nonionic surface active agents such as polyoxyethylene ethers of glycerol esters, polyoxyethylene ethers of sorbitan esters and polyoxyethylene ethers of sorbitol esters; ester-type nonionic surface active agents such as polyethylene glycol aliphatic acid esters, glycerol esters, sorbitan esters, propylene glycol esters and oligosaccharide esters; and nitrogen-containing nonionic surface active agents such as aliphatic acid alkanolamides, polyoxyethylene aliphatic acid amides, polyoxyethylene aliphatic acid amides, polyoxyethylene alkylamines and amine oxides.

Concrete examples of the cationic surface active agent available in this invention are higher aliphatic acid primary amine salts, higher aliphatic acid secondary amine salts, higher aliphatic acid tertiary amine salts, ester linkage amines, amide bond amines, ether bond amines, amide bond pyridinium salts, ester linkage pyridinium salts, ether bond pyridinium salts and quaternary ammonium salts.

In this invention, the surface active agents may be used singly or in combination.

Where the high-molecular organic compound forming the hydrous gel and the surface active agent are conjointly used in this invention, a synergistic effect can be obtained if the amount of the surface active agent is determined within the range of not more than 90%, preferably not more than 80% based on the total weight of the high-molecular organic compound and the surface active agent. Preferred proportions of the high molecular compound and surface active agent are each in an amount of 0.005 to 0.5% by weight, based on the starting coal.

The mineral oil used in this invention is not particularly limited. Concrete examples of the mineral oil are a petroleum, a gas oil, an A heavy oil, a B heavy oil, a C heavy oil, a lubricant and a waste oil.

When the high-molecular organic compound forming the hydrous gel, the surface active agent and the mineral oil are conjointly used in this invention, it is advisable for obtaining a synergistic effect that the total weight of the surface active agent and the mineral oil is determined in the range of not more than 90%, preferably not more than 80% based on the total weight of the surface active agent, the mineral oil and the high-molecular organic compound forming the hydrous gel. At this time, the surface active agent to mineral oil ratio is not particularly limited, but the higher proportion of the mineral oil is economically more advantageous. Preferred proportions of the high-molecular organic compound, surface active agent and mineral oil, based on the weight of the starting coal, are 0.005 to 0.5, 0.005 to 0.5, and 0.01 to 3% by weight, respectively.

In this invention, the amount of the bulk density improving agent composed of the high-molecular organic compound forming the hydrous gel is not less than 0.005% based on the dry weight of the starting coal, though it varies with qualities of the starting coals. There is no upper limit of the amount. However, when the amount is too large, the costs of starting materials become high and the effect becomes maximal with the fixed amount of the improving agent. From these aspects, the upper limit is usually 5% by weight.

In this invention, the form of the bulk density improving agent when mixed with the starting coal is not particularly limited, and may be a powdery state, or a state gelled with a small amount of water, or a state dissolved or dispersed in a solvent, or any other states.

In this invention, a period in which to add the bulk density improving agent to the starting coal is not particularly limited either; it is added in one or more of steps of producing the starting coal (a pulverizing step, a transporting step, a step of charging into a coke oven, and so forth).

Moreover, a solvent, etc. may be conjointly used unless impairing the effect of this invention.

This invention can thus improve the filling density of the starting coal in charging it into the coke oven, and stabilize and improve the qualities of the coke in comparison with the prior techniques.

The following Examples illustrate this invention more specifically. Parts and percentages in the Examples are by weight unless otherwise indicated.

EXAMPLE 1

A coal was pulverized by a pulverizer such that the content of particles having a particle size of not more than 3 mm became 80%, and three types of slacks having moisture contents of 8.0%, 5.0% and 2.0% were prepared. After 400 g of each of the slacks was stirred with a mortar mixer, about 500 ml of the slack was charged into a 500-milliliter graduated cylinder which was then vibrated for 30 seconds by means of a vibrator. Thereafter, the volume and the weight of the mixture in the graduated cylinder were measured. Bulk density was found by dividing the weight (kg) by the volume (liter). The bulk densities were 0.662 [called "bulk density (A)"], 0.680 and 0.740.

Subsequently, bulk density (B) was found as above except that a high-molecular compound forming a hydrous gel shown in Table 1 was added to the fine slack having the moisture content of 8.0%. A bulk density improvement ratio was obtained by dividing the bulk density (B) by the bulk density (A). The results are shown in Table 1.

The results in Table 1 reveal that using the bulk density improving agent in this invention, the bulk density of the starting coal is improved and the filling density of the starting coal in producing the coke is therefore improved.

TABLE 1

| Run No. | | High-molecular organic compound forming a hydrous gel: Type | Amount (%) *1 | Bulk density (kg/l) | Bulk density improvement ratio (%) |
|---|---|---|---|---|---|
| Invention | (1) | Gelatin *2 | 0.1 | 0.680 | 2.7 |
| | (2) | Sodium alginate *3 | " | 0.681 | 2.9 |
| | (3) | Starch *4 | " | 0.687 | 3.8 |
| | (4) | Casein *5 | " | 0.679 | 2.6 |
| | (5) | Methyl cellulose *6 | " | 0.686 | 3.6 |
| | (6) | Hydroxypropylmethyl cellulose *7 | " | 0.686 | 3.6 |
| | (7) | Crosslinked polyacrylic acid salt *8 | 0.025 | 0.696 | 5.1 |
| | (8) | " | 0.05 | 0.715 | 8.0 |
| | (9) | " | 0.1 | 0.733 | 10.7 |
| | (10) | " | 0.4 | 0.778 | 17.5 |
| | (11) | " | 0.8 | 0.802 | 21.1 |
| | (12) | Vinyl acetate-acrylic acid ester copolymer crosslinked product *9 | 0.1 | 0.711 | 7.4 |
| | (13) | Isobutylene-maleic anhydride copolymer crosslinked product *10 | " | 0.720 | 8.8 |
| | (14) | Starch-acrylic acid graft copolymer *11 | " | 0.659 | 5.0 |
| Control | (15) | Slack having a moisture content of 8.0% | — | 0.662 | — |
| | (16) | Slack having a moisture content of 5.0% | — | 0.680 | — |
| | (17) | Slack having a moisture content of 2.0% | — | 0.740 | — |

(Note)
*1 Amount based on the dry weight of a slack
*2 BACTO GELATIN (a trademark for a product of Difco Laboratories)
*3 First class grade chemical made by Wako Pure Chemical Industries Ltd.
*4 First class grade chemical made by Wako Pure Chemical Industries Ltd.
*5 HAMMARSTEIN CASEIN (a trademark for a product of Merck)
*6 METOLOSE SM-1500 (a trademark for a product of Shin-Etsu Chemical Co., Ltd.)
*7 METOLOSE 65SH (a tradename for a product of Shin-Etsu Chemical Co., Ltd.)
*8 AQUA KEEP 10SH (a trademark for a product of Seitetsu Kagaku Co., Ltd.); water absorption ratio-800 to 1000 times
*9 SUMIKAGEL S-50 (a trademark for a product of Sumitomo Chemical Co., Ltd.); water absorption ratio-500 to 700 times
*10 KI GEL 201K (a trademark for a product of Kuraray Co., Ltd.); water absorption ratio-200 times
*11 SANWET IM1000 (a trademark for a product of Sanyou Chemical Industries Ltd.); water absorption ratio-1000 times

EXAMPLE 2

A slack (a) having a moisture content of 8.0% was dried to obtain a slack (b) having a moisture content of 5.0% and a slack (c) having a moisture content of 2.0%. Moreover, to a slack having a moisture content of 8.0% was added 0.4% of a crosslinked polyacrylic acid salt to obtain a slack (d). These slacks (a), (b), (c) and (d) were classified through a sieve having a nominal size of 88 microns. The ratios of said slacks based on the total slack weight of fine particles passed through the sieve are found to be (a) 0.2%, (b) 5.3%, (c) 9.6% and (d) 1.8%.

From the above results, it follows that the addition of the bulk density improving agent in this invention to the slack can more suppress the formation of fine particles in the slack than the reduction of the moisture content in the slack. Accordingly, it can be expected that when the slack containing the bulk density improving agent in this invention is used, there can be minimized a risk that the dust flies within the coke producing device.

EXAMPLE 3

After a coal was pulverized with a pulverizer such that the content of particles having a particle size of not more than 3 mm became 80%, a crosslinked polyacrylic acid salt (ACRYHOPE GH-2, a tradename for a product made by Nippon Shokubai Kagaku Kogyo K.K.: water absorption ratio 150 to 200 times) and an anionic surface active agent (lauryl sulfate: EMAL2F, a trademark for a product made by Kao Corporation) were added in the total amount of 1 g at a ratio shown in Table 2 to 500 g of the slack having the moisture content of 10%. The mixture was stirred with a mortar (mixer) for 3 minutes. Bulk density of the obtained mixture was measured as in Example 1. The results are shown in Table 2.

For comparison, bulk densities were also measured in case of adding the anionic surface active agent alone and adding neither the anionic surface active agent nor the bulk density improving agent. The results are shown in Table 2.

Incidentally, the bulk density improvement ratio indicates a degree of improvement in bulk density in case of using the bulk density improving agent relative to the bulk density in case of using no bulk density improving agent.

TABLE 2

| Run No. | | Amount of each component (%)* Crosslinked polyacrylic acid salt (component A) | Surface active agent (component B) | Component A/ component B ratio | Total amount (%)* | Bulk density (kg/l) | Bulk density improvement ratio (%) |
|---|---|---|---|---|---|---|---|
| Inven- | (1) | 0.2 | — | 100/0 | 0.20 | 0.800 | 14.0 |
| tion | (2) | 0.15 | 0.05 | 75/25 | 0.20 | 0.812 | 15.7 |
| | (3) | 0.10 | 0.10 | 50/50 | 0.20 | 0.820 | 16.8 |
| | (4) | 0.05 | 0.15 | 25/75 | 0.20 | 0.811 | 15.5 |
| | (5) | 0.02 | 0.18 | 10/90 | 0.20 | 0.793 | 13.0 |
| control | (6) | — | 0.2 | 0/100 | 0.20 | 0.783 | 11.5 |
| | (7) | — | — | — | — | 0.702 | — |

*Amount based on the dry weight of a slack

EXAMPLE 4

The procedure of Example 3 was followed except using a starch-acrylic acid graft copolymer (SANWET IM 1000, a trademark for a product made by Sanyou Chemical Industries Ltd.) instead of the crosslinked polyacrylic acid salt. The results are shown in Table 3.

TABLE 3

| Run No. | | Amount of each component (%)* Starch-acrylic acid graft copolymer (component A) | Surface active agent (component B) | Component A/ component B ratio | Total amount (%)* | Bulk density (kg/l) | Bulk density improvement ratio (%) |
|---|---|---|---|---|---|---|---|
| Inven- | (1) | 0.2 | — | 100/0 | 0.20 | 0.806 | 14.8 |
| tion | (2) | 0.15 | 0.05 | 75/25 | 0.20 | 0.818 | 16.5 |
| | (3) | 0.10 | 0.10 | 50/50 | 0.20 | 0.821 | 17.0 |
| | (4) | 0.05 | 0.15 | 25/75 | 0.20 | 0.813 | 15.8 |
| | (5) | 0.02 | 0.18 | 10/90 | 0.20 | 0.800 | 13.9 |
| control | (6) | — | 0.2 | 0/100 | 0.20 | 0.783 | 11.5 |
| | (7) | — | — | — | — | 0.702 | — |

*Amount based on the dry weight of a slack

EXAMPLE 5

The procedure of Example 3 was followed except using an isobutylene-maleic anhydride copolymer salt crosslinked product (KI GEL 201K, a tradename for a product made by Kuraray Co., Ltd.) instead of the crosslinked polyacrylic acid salt. The results are shown in Table 4.

TABLE 4

| Run No. | | Amount of each component (%)* Isobutylene-maleic anhydride copolymer salt crosslinked product (component A) | Surface active agent (component B) | component A/ component B ratio | Total amount (%)* | Bulk density (kg/l) | Bulk density improvement ratio (%) |
|---|---|---|---|---|---|---|---|
| Inven- | (1) | 0.2 | — | 100/0 | 0.20 | 0.793 | 13.0 |
| tion | (2) | 0.10 | 0.10 | 50/50 | 0.20 | 0.799 | 13.8 |
| | (3) | 0.02 | 0.18 | 10/90 | 0.20 | 0.793 | 13.0 |
| control | (4) | — | 0.2 | 0/100 | 0.20 | 0.783 | 11.5 |
| | (5) | — | — | — | — | 0.702 | — |

*Amount based on the dry weight of a slack

EXAMPLE 6

The procedure of Example 3 was followed except using the surface active agents shown in Table 5 instead of EMAL 2F. The results are shown in Table 5.

TABLE 5

| Run No. | | Amount of crosslinked polyacrylic acid salt (component A) (%)* | Surface active agent (component B) Type | Amount (%)* | component A/ component B ratio | Total amount (%)* | Bulk density (kg/l) | Bulk density improvement ratio (%) |
|---|---|---|---|---|---|---|---|---|
| Inven- | (1) | 0.20 | — | — | 100/0 | 0.20 | 0.800 | 14.0 |
| tion | (2) | 0.10 | Sodium dialkyl-sulfosuccinate *1 | 0.10 | 50/50 | 0.20 | 0.816 | 16.3 |
| | (3) | 0.10 | Polyoxyethylene | 0.10 | 50/50 | 0.20 | 0.809 | 15.2 |

TABLE 5-continued

| Run No. | | Amount of crosslinked polyacrylic acid salt (component A) (%)* | Surface active agent (component B) Type | Amount (%)* | component A/ component B ratio | Total amount (%)* | Bulk density (kg/l) | Bulk density improvement ratio (%) |
|---|---|---|---|---|---|---|---|---|
| | | | polyoxypropylene *2 | | | | | |
| control | (4) | — | Sodium dialkyl-sulfosuccinate *1 | 0.2 | 0/100 | 0.20 | 0.790 | 12.5 |
| | (5) | — | Polyoxyethylene polyoxypropylene *2 | 0.2 | 0/100 | 0.20 | 0.759 | 8.1 |
| | (6) | — | — | — | — | — | 0.702 | — |

*Amount based on the dry weight of a slack
*1 Anionic surface active agent, PELEX OTP (a trademark for a product of Kao Soap Co., Ltd.)
*2 Nonionic surface active agent, EMULGEN PP-230 (a trademark for a product of Kao Soap Co., Ltd.)

EXAMPLE 7

The procedure of Example 3 was followed except that a nonionic surface active agent (polyoxyethylene polyoxypropylene) was replaced with the anionic surface active agent, and said agent and the crosslinked polyacrylic acid salt were used in the total amount of 0.5 g at a ratio shown in Table 6. The results are shown in Table 6.

TABLE 6

| Run No. | | Amount of each component (%)* Crosslinked polyacrylic acid salt *1 (component A) | Surface active agent *2 (component B) | Component A/ component B ratio | Total amount (%)* | Bulk density (kg/l) | Bulk density improvement ratio (%) |
|---|---|---|---|---|---|---|---|
| Invention | (1) | 0.1 | — | 100/0 | 0.10 | 0.764 | 8.9 |
| | (2) | 0.075 | 0.025 | 75/25 | 0.10 | 0.773 | 10.1 |
| | (3) | 0.05 | 0.05 | 50/50 | 0.10 | 0.778 | 10.8 |
| | (4) | 0.025 | 0.075 | 25/75 | 0.10 | 0.767 | 9.3 |
| | (5) | 0.01 | 0.09 | 10/90 | 0.10 | 0.751 | 7.0 |
| control | (6) | — | 0.1 | 0/100 | 0.10 | 0.743 | 5.8 |
| | (7) | — | — | — | — | 0.702 | — |

*Amount based on the dry weight of a slack
*1 ACRYHOPE GH-2
*2 EMULGEN PP-230

EXAMPLE 8

The procedure of Example 3 was followed except using components shown in Table 7 as a bulk density improving agent in the total amount of 1 g at a ratio shown in Table 7. The results are shown in Table 7.

TABLE 7

| Run No. | | Amount of each component (%)* Isobutylene-maleic anhydride copolymer salt crosslinked product (component A) | Surface active agent *2 (component B) | B-heavy oil (component C) | component A/ component B ratio | Total amount (%)* | Bulk density (kg/l) | Bulk density improvement ratio (%) |
|---|---|---|---|---|---|---|---|---|
| Invention | (1) | 0.20 | — | — | 100/0/0 | 0.20 | 0.793 | 13.0 |
| | (2) | 0.10 | 0.10 | — | 50/50/0 | 0.20 | 0.799 | 13.8 |
| | (3) | 0.067 | 0.067 | 0.067 | 33/33/33 | 0.20 | 0.807 | 14.9 |
| | (4) | 0.05 | 0.05 | 0.1 | 25/25/50 | 0.20 | 0.801 | 14.1 |
| | (5) | 0.02 | 0.02 | 0.16 | 10/10/80 | 0.20 | 0.773 | 10.1 |
| control | (6) | — | — | 0.2 | 0/0/100 | 0.20 | 0.731 | 4.2 |
| | (7) | — | 0.10 | 0.10 | 0/50/50 | 0.20 | 0.765 | 9.0 |
| | (8) | — | — | — | — | — | 0.702 | — |

*Amount based on the dry weight of a slack
*1 KI GEL 201K
*2 EMAL 2F

From the results in Examples 3–8, it follows that according to the process for producing the coke in this invention, the excellent effects are obtained from both the aspects of improvement in bulk density of the starting coal and suppression of the amount of the fine slack in the starting coal.

What we claim is:

1. In a process for producing coke by carbonization of a starting coal, the improvement which comprises carbonizing a starting coal containing a bulk density improving effective amount of a bulk density improving agent comprising a water-insoluble synthetic resin having a high molecular network three-dimensionally crosslinked physically or chemically and capable of absorbing or adsorbing distilled water in an amount of 5 to 1000 times its own weight and capable of forming a hydrous gel in the presence of moisture.

2. The process of claim 1 wherein the bulk density improving agent further comprises a surface active agent.

3. The process of claim 1 wherein the bulk density improving agent further comprises a surface active agent and mineral oil.

4. The process of claim 2 or 3 wherein the amount of each of the water-insoluble synthetic resin and the surface active agent is in the range of from 0.005 to 0.5% by weight based on the starting coal.

5. The process of claim 2 wherein the amount of the surface active agent is not more than 90% by weight based on the total amount of the water-insoluble synthetic resin and the surface active agent.

6. The process of claim 2 or 3 wherein the surface active agent is an anionic or nonionic surface active agent.

7. The process of claim 3 wherein the amount of each of the water-insoluble synthetic resin and surface active agent is 0.005 to 0.5% by weight based on the starting coal, and the amount of mineral oil is 0.01 to 3% by weight based on the starting coal.

8. The process of claim 3 wherein the total amount of surface active agent and mineral oil is not more than 90% by weight based on the total amount of water-insoluble synthetic resin, surface active agent and mineral oil.

9. The process of claim 1 wherein the amount of the bulk density improving agent is from 0.005 up to about 1% by weight based on the starting coal.

10. The process of claim 1 wherein the waterinsoluble synthetic resin is obtained by physically or chemically crosslinking a water-soluble high-molecular synthetic compound.

11. The process of claim 1 wherein the starting coal is slack.

* * * * *